US012721400B2

(12) United States Patent
Deslauriers et al.

(10) Patent No.: US 12,721,400 B2
(45) Date of Patent: Sep. 1, 2026

(54) FOOT POSITIONING SYSTEM FOR SURGERY

(71) Applicant: Contract Medical Manufacturing LLC, Oxford, CT (US)

(72) Inventors: Richard Deslauriers, Woodbury, CT (US); Patrick Brandon, Killingworth, CT (US)

(73) Assignee: Contract Medical Manufacturing LLC, Oxford, CT (US)

( * ) Notice: Subject to any disclaimer, the term of this patent is extended or adjusted under 35 U.S.C. 154(b) by 0 days.

(21) Appl. No.: 18/989,214

(22) Filed: Dec. 20, 2024

(65) Prior Publication Data

US 2025/0234956 A1 Jul. 24, 2025

Related U.S. Application Data

(60) Provisional application No. 63/624,343, filed on Jan. 24, 2024.

(51) Int. Cl.
*A43B 7/143* (2022.01)
*A43B 7/28* (2006.01)

(52) U.S. Cl.
CPC ..... *A43B 7/143* (2013.01); *A43B 7/28* (2013.01)

(58) Field of Classification Search
CPC ..... A61G 13/1245; A61G 13/125; A61G 13/1265; A61G 13/127; A61G 13/12; A61G 7/0755; A61F 5/0195; A61F 5/0585; A61F 5/3761; A61F 5/0111; A61F 5/0113; A61F 5/0116; A61F 5/0127; A43B 7/143; A43B 7/28
USPC ..... 128/882
See application file for complete search history.

(56) References Cited

U.S. PATENT DOCUMENTS 2,878,493 A * 3/1959 Delia ..... A61G 7/0755 5/651
3,511,233 A * 5/1970 Holy, Jr. ..... A61F 13/069 5/651
5,329,705 A * 7/1994 Grim ..... A61F 5/0111 36/95
2007/0021702 A1* 1/2007 Cotton ..... A61F 5/0585 602/33
2009/0192428 A1* 7/2009 DeBoer ..... A61F 13/065 602/65
2013/0318721 A1* 12/2013 Gauta ..... A61G 13/1245 5/624
2018/0221190 A1* 8/2018 Kaiser ..... A61F 5/05841

* cited by examiner

*Primary Examiner* — Tarla R Patel

(57) ABSTRACT

An insert for use during orthopedic surgery configured for positioning in or on a boot configured to stabilize a foot of the patient during orthopedic surgery. The insert is sterile and includes a heel region, a toe region and an arch support positioned between the toe and heel region, the arch support configured to support an arch of the foot of the patient during stabilization of the foot during orthopedic surgery thereby preventing collapse of the arch during securement of the foot in the boot.

10 Claims, 9 Drawing Sheets

FOOT POSITIONING SYSTEM FOR SURGERY

This application claims priority to provisional application Ser. No. 63/624,343 filed Jan. 24, 2024, the entire contents of which are incorporated herein by reference.

BACKGROUND OF THE INVENTION

Field of the Invention

This application relates to a foot positioning system for surgery, and, more particularly, to an insert to support a patient's arch during such foot positioning to reduce the risk of collapsing of the arch and its associated adverse affects.

Background

During surgery such as partial knee arthroplasty (PKA) or total knee arthroplasty (TKA), the patient's foot/leg needs to be firmly supported and immobilized. This is especially critical during robotic surgery since the robot cannot accommodate movement during surgery.

In order to achieve such immobilization, the patient's foot is supported in a boot and secured within the boot by a tightening mechanism such as buckles, straps or lacing systems. Wrappings around the foot are also often utilized. However, when the patient's foot is tightly secured in the boot, it collapses the arch which can lead to changing the knee alignment, i.e., cause deleterious knee imbalances. Current positioning techniques are not patient specific so they fail to take into account the specific anatomy, e.g., knee anatomy, of the patient as the limb alignment in the population varies from valgus to varus. That is, the current boots provide a pre-specified positioning of the limb and foot. The current issues with alignment are highlighted in "Current concepts for aligning knee implants: patient specific or systemic", by Charles Riviere et al, EFFORT, Jan. 8, 2018.

The need therefore exists to reduce the risk of altering knee alignment caused by immobilization of the patient's foot during knee (or hip) surgery. That is, the need exists for an improved patient foot positioning system that provides increased comfort and limits the adverse effects associated with collapsing of the patient's arch during surgery.

SUMMARY OF THE INVENTION

The present invention overcomes the problems and deficiencies of the prior art. The present invention provides an intraoperative arch supporting insert or orthotic which supports the arch during surgery, especially during orthopedic knee surgery. The arch supporting insert is configured for use with a surgical boot into which the patient's foot and leg are placed. A foam insert (pad) is placed in the boot to cushion the patient's foot and leg. The arch supporting insert of the present invention in some embodiments is placed on top of the foam insert; in other embodiments is placed under the foam insert; and in other embodiments is placed within, e.g., embedded or otherwise integrated with, the foam insert. The arch supporting insert provides an intraoperative orthotic used during surgery to maintain proper alignment or positioning of the joint to prevent the ill affects currently associated with the pre-specified positioning of current boots which do not take into account the particular anatomy of the patient. The arch supporting inserts have features to support the arch so reduce the risk of misalignment which can occur during securement of the foot in the boot. Such misalignment can adversely affect the surgical outcome since the anatomical angle can change.

The arch supporting inserts have features to support the arch during the lengthy time of foot stabilization during the surgical procedure, thereby preventing injury to the foot which can otherwise occur due to prolonged immobilization in the boot.

Various types of arch supporting inserts (orthotics) can be utilized, as described in detail below.

In some embodiments, the orthotic is non-removably attached to the foam pad; in other embodiments, the orthotic is removably attached to the foam pad.

The orthotics are configured for right foot and left foot support, depending on the surgical procedure.

With current advances in robotic surgery, surgeons can make bone cuts that are more accurate—previously their cuts were not accurate enough to worry about small amounts of pronation. Now it matters and the present invention provides a solution to even more accurate knee replacements as it reduces the misalignment and changed angle and thereby improves the surgical outcome.

In accordance with one aspect of the present invention, an insert for use during orthopedic surgery is provided, the insert configured for positioning in or on a boot configured to stabilize a foot of the patient during orthopedic knee surgery. The insert is sterile and includes a heel region, a toe region and an arch support positioned between the toe and heel region, the arch support configured to support an arch of the foot of the patient during stabilization of the foot during orthopedic knee surgery thereby preventing collapse of the arch during securement of the foot in the boot.

Preventing collapse of the arch improves surgical outcomes as it reduces inaccuracies in the surgery due to foot arch collapse, pronation and knee alignment changes.

In some embodiments, the insert is placed in a stabilization boot stabilizing the foot of the patient during orthopedic knee surgery.

The sterilized insert can be placed on top of a pad, e.g., a foam insert (pad), positioned on the stabilization boot, underneath the foam insert positioned on the stabilization boot or can be embedded in the foam insert positioned on the stabilization boot.

In some embodiments the insert is integral with the foam insert positioned on the stabilization boot.

In some embodiments, the insert is customized to accommodate the foot of the patient.

In some embodiments, the insert is positioned in one of the left or right boot to accommodate the left or right foot of the patient accordingly.

In accordance with another aspect of the present invention, a system for supporting a foot of the patient during surgery is provided comprising a) a stabilization boot for supporting the foot of a patient, the stabilization boot including a lower region to accommodate a foot of the patient and an upper region to accommodate a portion of a leg of the patient, the stabilization boot including a tightening mechanism to secure the leg of the patient; b) a pad, e.g., a foam pad, positioned on or in the boot to cushion one or both of the foot and leg of the patient; and c) a sterile arch supporting insert, the arch supporting insert including an arch support region to prevent collapse of the arch of the patient during securement of the foot in the boot during orthopedic surgery.

In some embodiments, the arch supporting insert is embedded in the foam pad.

In some embodiments, the arch supporting insert is integral with the foam pad.

In some embodiments, the arch supporting insert is independent of the foam pad and positionable either on top of or under the foam pad for the orthopedic surgery.

In accordance with another aspect of the present invention, a device for supporting a foot of a patient during orthopedic knee surgery is provided, the device being sterile and comprising a pad, e.g. a foam pad, configured for placement on a foot positioning boot which stabilizes the patient's foot during orthopedic knee surgery. The foam pad includes a foot region, a leg region and an arch supporting region to support an arch of the patient and preventing collapse of the arch during stabilization of the patient's foot during orthopedic knee surgery. Such stabilization improves surgical outcomes.

BRIEF DESCRIPTION OF THE DRAWINGS

So that those having ordinary skill in the art to which the subject invention appertains will more readily understand how to make and use the surgical apparatus disclosed herein, preferred embodiments thereof will be described in detail hereinbelow with reference to the drawings, wherein.

DETAILED DESCRIPTION OF PREFERRED EMBODIMENTS

The present invention provides an improved foot positioning system for surgical procedures such as orthopedic knee surgery. The foot positioning system of the present invention provides an insert to reduce the risk of altering the patient's knee alignment as a result of foot immobilization during surgery. More specifically, the system includes an arch supporting insert that can be a separate unit or integrated into the system as described in detail below. The insert thus provides a sterile intraoperative orthotic used during surgery to maintain proper alignment or positioning of the joint. By maintaining proper alignment, the surgery, e.g., the surgical cutting, can be more precise leading to better surgical outcomes.

Note that the terms insert, arch insert, arch support, arch supporting insert and orthotic are used interchangeably herein. The term foam pad or foam insert refers to the foam material that is placed in the stabilization boot.

The different types of orthotics that can be utilized are selected to provide a device to minimize arch collapse during surgical foot stabilization caused by strapping/locking the foot/ankle in place just before surgery, e.g., knee surgery. The flat metal boot and flat sterile foam currently utilized during orthopedic surgery do not provide any arch support, causing the foregoing problems.

During knee surgery such as partial knee arthroplasty (PKA) or total knee arthroplasty (TKA), the patient's foot and lower leg need to be firmly supported and immobilized. To achieve such immobilization, the foot and leg are placed in a foot positioning device/system in the form of a boot and tightly secured thereto/therein. Such immobilization is especially critical during robotic surgery since the robot cannot accommodate movement during surgery, but is also important during surgeon-performed surgery.

Figure 3A:
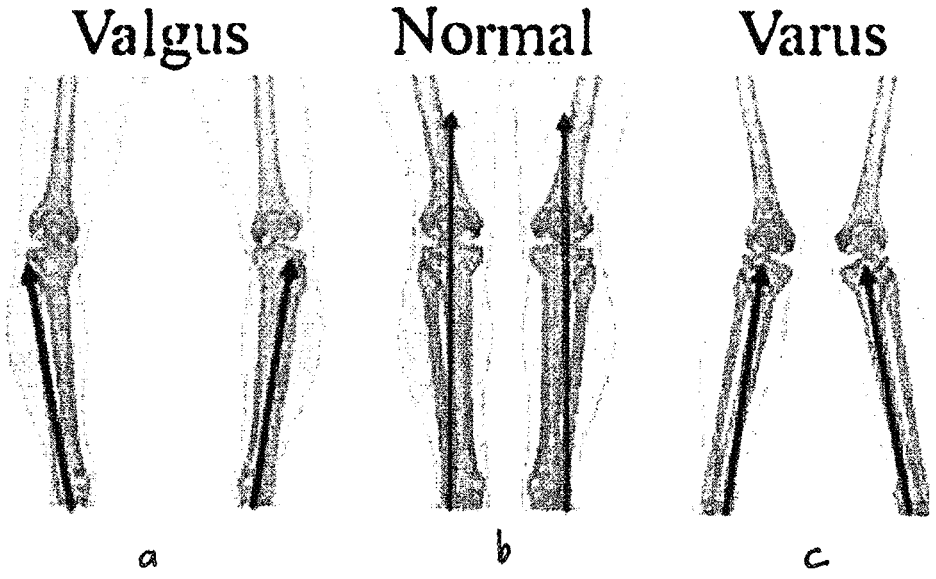
FIG. 3A is a schematic view showing valgus and varus deformities of the lower leg of an individual, compared to the normal condition, which can be caused or exacerbated due to misalignment when the patient is secured/strapped to the boot for a prolonged period of time for a surgical procedure such as knee or hip surgery.
Figure 3B:
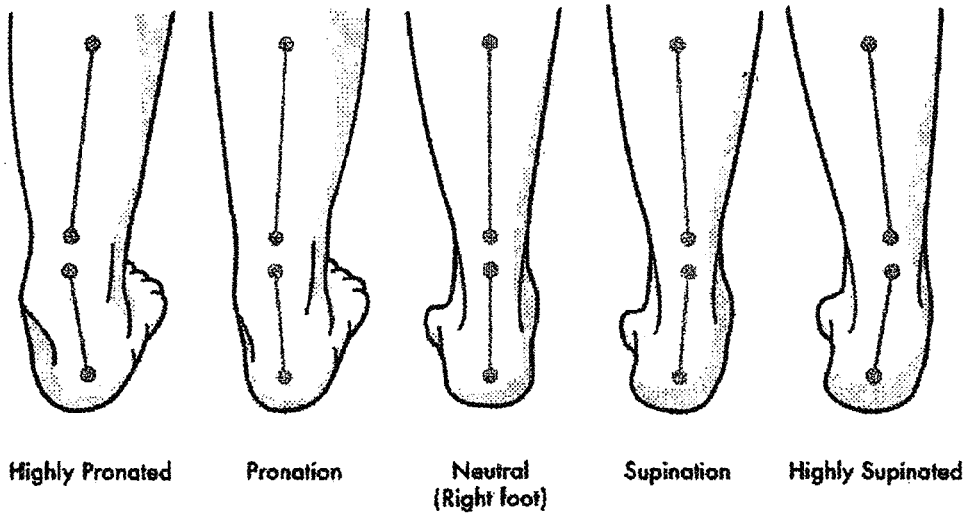
FIG. 3B illustrates foot pronation and supination.
Figure 3C:
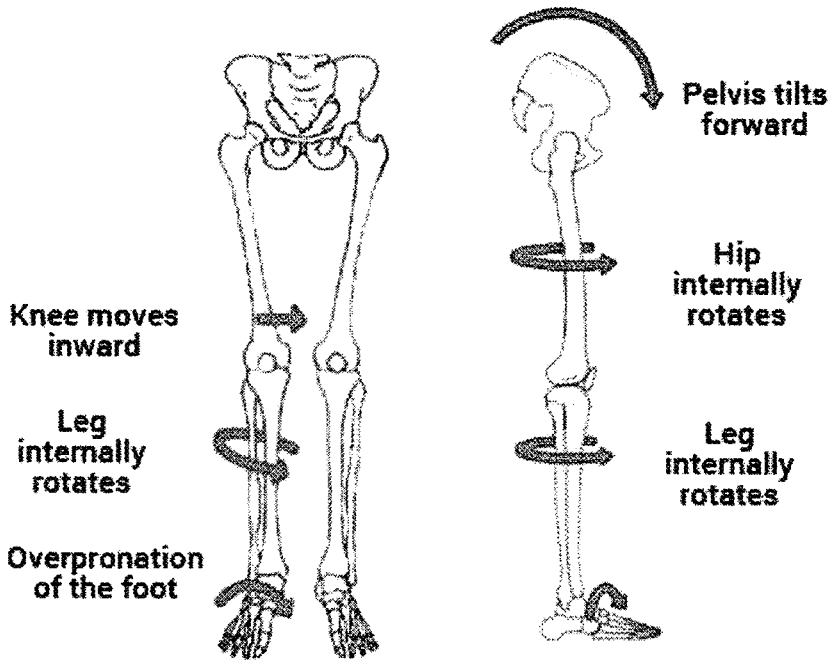
FIG. 3C illustrates overpronation of foot showing knee and leg movement.

The foot positioning system (device), also referred to herein as the "surgical boot", includes a series of straps, buckles, laces or other forms of tightening mechanisms to wrap over the patient's foot and lower leg to secure and immobilize the patient's foot within the boot. A wrapping such as Coflex can also be utilized around the foot. However, as mentioned above, when the patient's foot is tightly secured in the boot, and the wrapping compresses the arch, it collapses the arch which can lead to changing the knee alignment, i.e., causing knee imbalances. Knee misalignment can be appreciated by the illustrations in FIG. 3A wherein (b) shows the normal position of the knee wherein the knee is in alignment, i.e., is in a straight tracking line, (a) shows the leg deformity of valgus knee where the bone at the knee joint is angled out and away from the body's midline (also referred to as bowlegs) and (c) shows the leg deformity of varus knee where the bone at the knee joint is angled inwardly (also referred to as knock knees). Overpronation of the foot can cause the leg to internally rotate and the knee move inward. This can also cause the hip to internally rotate and the pelvis to tilt upwardly, causing adverse effects such as patella femoral pain syndrome, strain of the side section of the hip and/or lower back pain. Over supination can cause the leg to externally rotate and the knee move outward, also resulting in hip and/or back pain. FIG. 3B is another view illustrating foot pronation and supination and high pronation and high supination. FIG. 3C illustrates overpronation of foot showing that the leg internally rotates, the knee moves inward, the hip internally rotates and the pelvis tilts forward.

The foot positioning system of the present invention is designed to prevent pronation or supination resulting from the tight securement in a surgical boot during knee surgery. That is, the positioning system is designed to hold the general correct anatomy of the patient. To achieve this, the positioning system adds an arch support to the surgical foam placed in the boot to maintain or enhance alignment before surgical cutting. By holding the correct outcome, the accuracy of the surgery is enhanced.

Referring now to the drawings and particular embodiments of the present invention, it should be noted that like reference numerals identify similar structural features of the devices disclosed herein.

Initially, a sample boot of the prior art which is currently utilized in orthopedic surgery will be discussed with reference to FIGS. 1 and 2. The boot is designated generally by reference numeral 10 and has a boot portion 12 supported on base 11 by support 14. The boot 10 can be slidable along the base in some embodiments and then locked in position. The boot 10 has a rigid/hard shell 13 having a channel to receive the foot and leg, a tightening mechanism to secure the patient's foot and leg within the boot 10 and a support pad composed of foam of other soft material that increases patient comfort within the hard shell boot 10. The support pad if composed of foam is also referred to herein as a foam insert or foam pad.

The shell 13 is preferably composed of a rigid material and has an upper end 20, a lower end 22 having a toe end 24 and a heel 26 forming a continuous heel region. The left side is designated by reference numeral 28 and the right side is designated by reference numeral 29. Extending from the sole portion 21 is the calf support portion 25 which is angled with respect to the sole portion in an approximate 70° to 90° angle. Note, as used herein, the term "left" and "right" refer to the orientation corresponding to the position of the patient's foot in the positioning device (boot).

The tightening mechanism 40 has a strap assembly including a series of straps. One or more top (upper) straps 42 secure the lower leg and calf portion and one or more bottom (lower) straps 44 secure the foot. The lower strap(s) 44 collapses the arch of the foot. The tightening mechanism 40 secures and immobilizes the patient's foot within the boot 10. As an alternative to straps, belts, lacing systems or other tightening mechanisms can be utilized. FIG. 1 illustrates the boot 10 and foam pad 16 with the tightening mechanism removed for clarity; FIG. 2 illustrates the patient's foot within the boot 10 showing the boot and foam pad 16 with the lower and upper straps 44, 42 shown wrapped around the patient's foot and leg, respectively.

Figure 1:
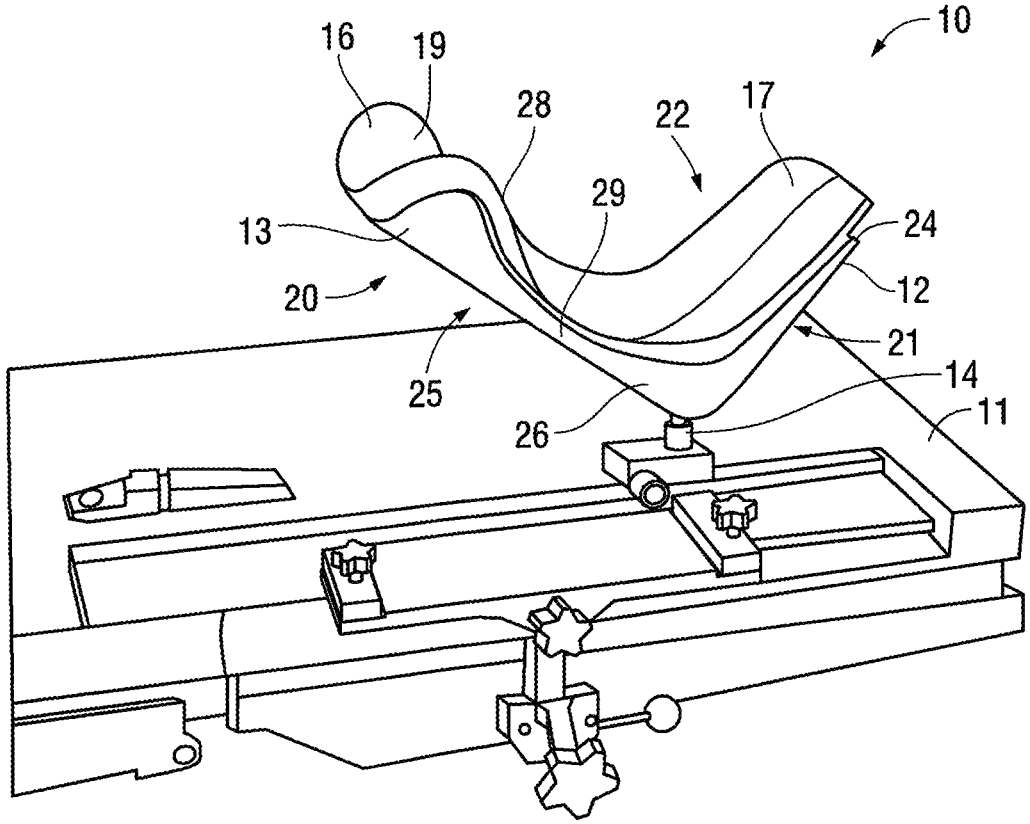
FIG. 1 is a perspective view of a conventional surgical boot for supporting a foot and leg of a patient during surgery, and further showing a conventional foam insert placed within the surgical boot to cushion the foot and leg.
Figure 2:
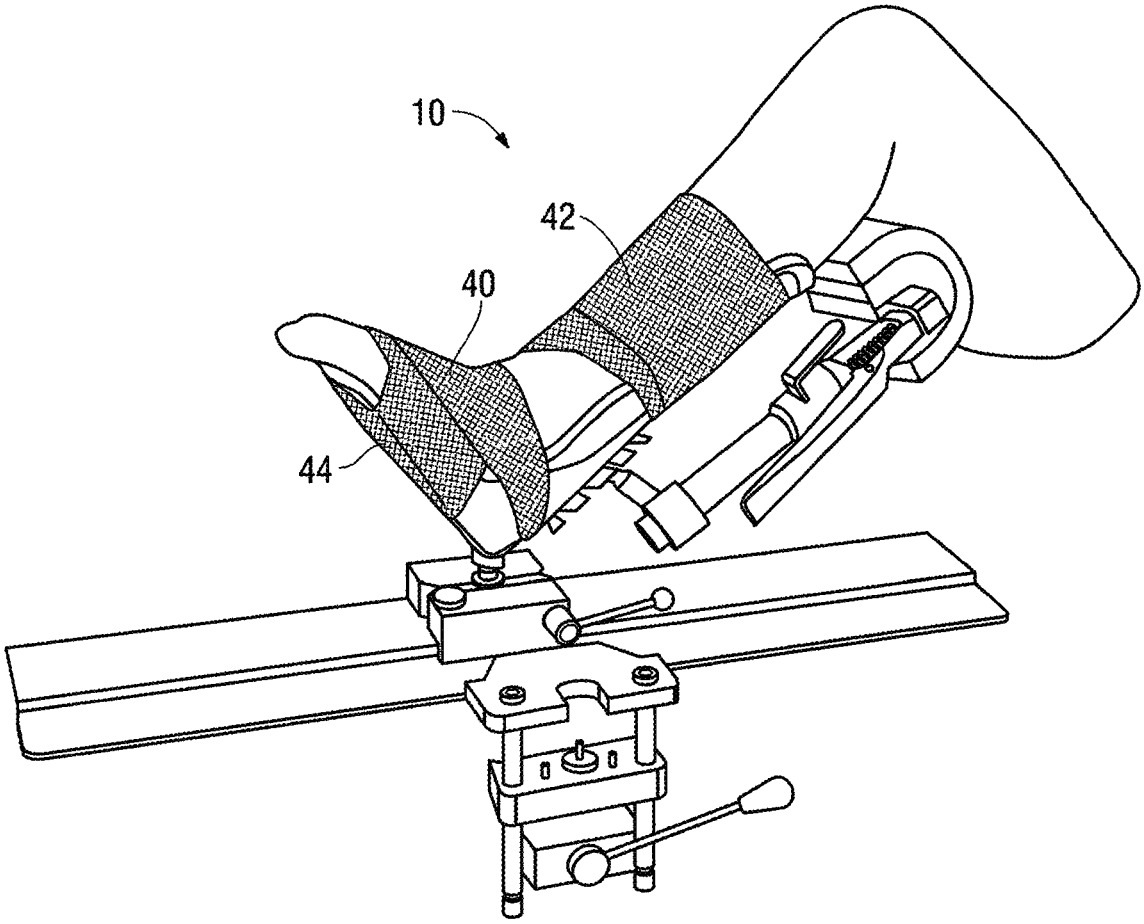
FIG. 2 is a perspective view of surgical boot shown supporting and securing a foot and leg of a patient for surgery.

A conventional foam pad 16 is shown in FIG. 1 placed within the boot 10. The pad 16 is preferably made of foam, although other materials can be utilized to cushion and provide a softer surface (as compared to the hard shell of the boot). The foam insert/pad 16, like the boot in which it is positioned, has a foot portion 17 and a continuous leg portion 19 and a heel portion extending continuously in a heel region and somewhat conforms in shape to the angled boot 10. The foam pad 16 in the illustrated embodiments extends slightly beyond the toe end 24 of the boot 10 and lightly beyond the upper end of the calf support portion 25, although other lengths are contemplated. The pad 16 can simply rest on the boot or alternatively can be secured to the boot 10. The pad 16 can be a separate unit packaged/sold separately for positioning on the boot or can be packaged/sold along with the boot and in still other embodiments be part of e.g., integral or attached to the boot and packaged/sold with the boot as a single assembly.

As shown, the conventional foam pad/insert of FIG. 1 has a relatively planar foot surface and is used with patients regardless of their specific anatomy. This causes the ill effects described herein.

Turning now to the intraoperative sterile inserts/orthotics for foam inserts of the present invention, and with reference to FIGS. 4-8, various embodiments of the inserts will now be described. As described below, the inserts in some embodiments are integral with the foam pad (FIGS. 4 and 5) and in other embodiments are separate components from the foam pad FIGS. 6 and 7).

The inserts provide an arch support to provide structure to the natural arch of the foot (between the heel of the foot and ball). The arch support promotes proper alignment of the foot and ankle, reducing stress on the joints and muscles. Promoting proper alignment ensures the surgeon is accurately addressing the target site as misalignment can lead to surgery off the target site.

Figure 5:
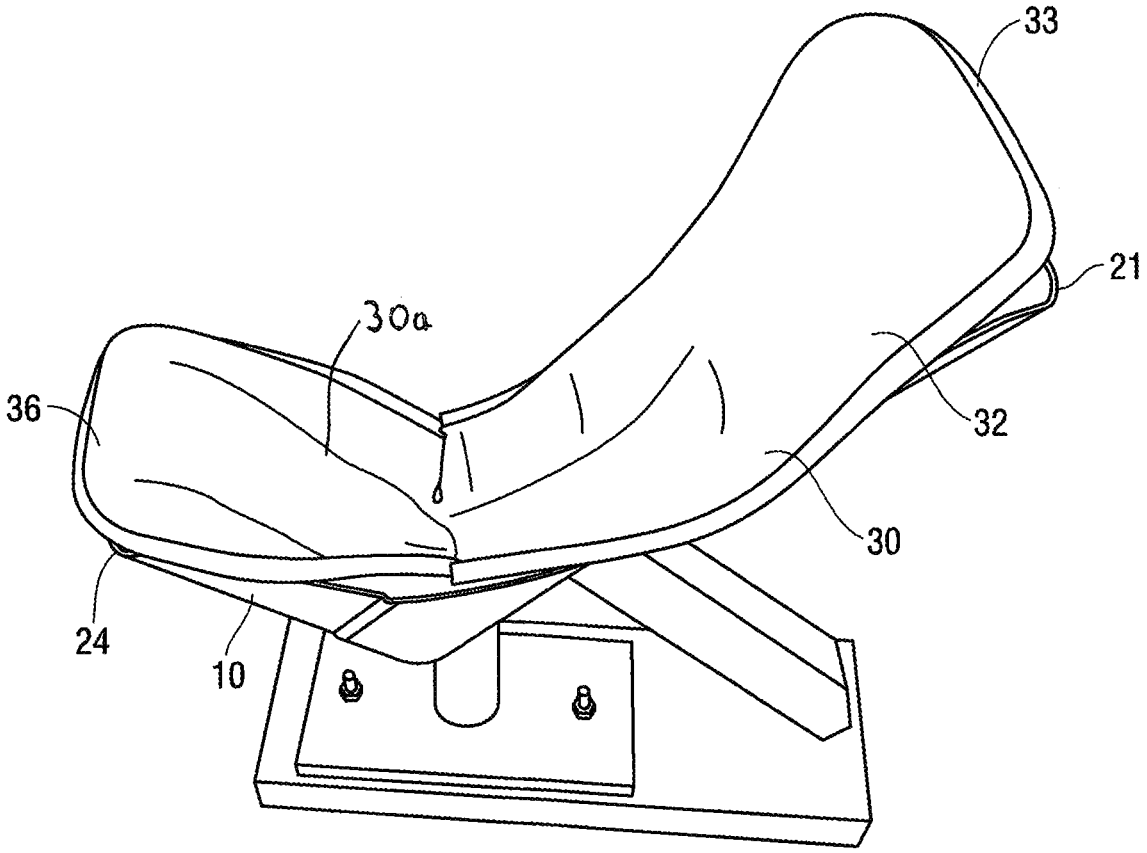
FIG. 5 is a perspective view showing an insert integrated into the foam pad of the boot, the tensioning mechanism and other components of the boot (surgical positioning device) removed for clarity.

With reference to FIG. 5, foam insert (pad) 30 differs from conventional foam pad/insert 16 by provision of an arch support to support the patient's foot. This support accommodates for different arches/feet of patients which can be pronated or supinated (as opposed to neutral). The arch support region 30*a* also prevents pronation or supination of the foot which can be caused by its immovable positioning within the stabilization boot for a long period of time during the surgical procedure. That is, as discussed in detail above, with current foam pads without arch supports, pronation or supination can cause knee misalignment when the patient's foot is tightened within the surgical boot for a prolonged period of time. The foam pad 30 with integrated arch support 30*a* of the present invention prevents or at least limits this. The foam pad with integrated arch support also improves the accuracy of the surgery across the different planes.

Note arch support 30*a* can be composed of foam or other soft materials to provide a soft cushion for the patient. The arch support 30*a* is integral with the foam pad. In some embodiments, it is integral with the foam pad by being formed as a unit with the pad. In other embodiments, it is a separate unit which is fully embedded (or partially embedded) in the foam pad. This embedded inserted can be considered as "integral" with the foam pad.

Figure 4:
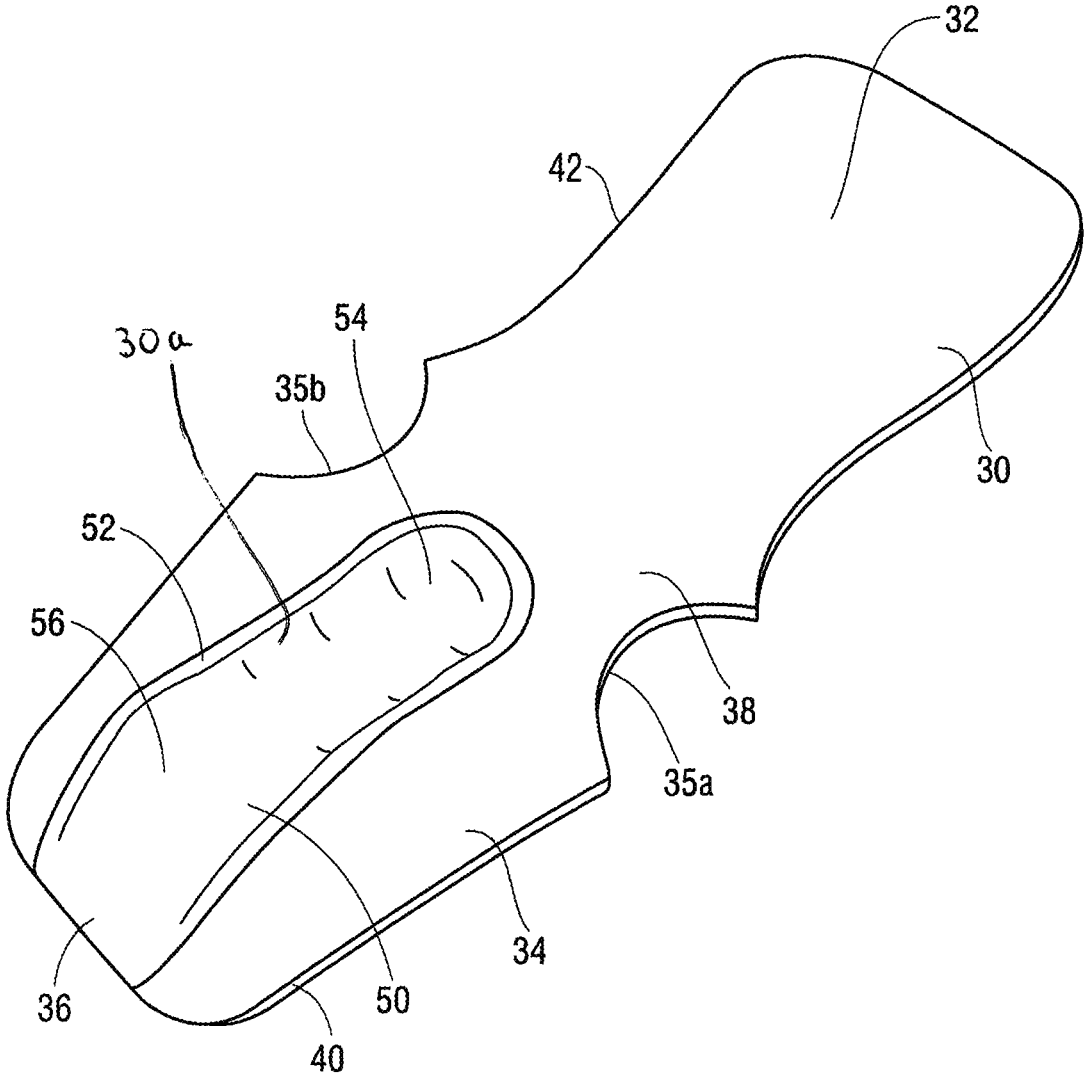
FIG. 4 is a perspective view of the boot insert of the present invention having an arch support embedded therein.

With reference to FIG. 4, foam insert 30 has an upper region 32 to provide a calf supporting portion and a lower region 34, angled with respect to the upper region 32, having a toe end 36 and a heel region 38 to provide a foot supporting portion. The upper region 32 is bent/folded with respect to the lower region 34 adjacent to the heel 38. Angles could be for example between about 70 degrees and about 90 degrees. The left side of the foam insert 30 is designated by reference numeral 40 and the right side is designated by reference numeral 42. The arch support region 30*a* is provided by an indentation 50, formed by a raised wall 52 about the periphery of the indentation 50. The indentation can be formed by removing material from the foam or alternatively raising the peripheral wall to create an indentation within the peripheral wall. The wall 52 has a heel portion 54 which the patient's heel abuts and a sole portion 56 to contact at least a portion of the patient's sole. The indentation 50 reduces in depth in a direction toward the toe and merges into the plane of the insert 50 at the toe end 36.

Insert 30 also has side indentations 35*a*, 35*b*, created by removal of some material, to aid in the flexibility and folding of the insert 30 as shown in FIG. 5 so it can bend to form the lower foot end and upper calf end within the boot 10.

Note FIG. 4 illustrates the foam insert 30 alone; FIG. 5 illustrates the foam insert 30 positioned in a surgical boot 10 which is supported on a base, i.e., on top of the foam insert and preferably attached thereto. As shown, the toe end 36 of the foam insert 30 extends beyond the toe end 24 of the boot 10 and the leg/calf end 33 of upper region 32 extends beyond the upper edge 21 of the upper end 20 of the boot 10 to ensure the patient is in contact with the soft insert and not the hard shell boot. The foam insert 30 can also extend beyond the left and right edges of the boot 10 as shown.

The arch support can be integral with the foam insert as shown in FIGS. 4 and 5. For example, it can be formed with foam insert, e.g., embedded within the foam pad. The foam pad can also be formed with the arch support formed therein.

Figure 6:
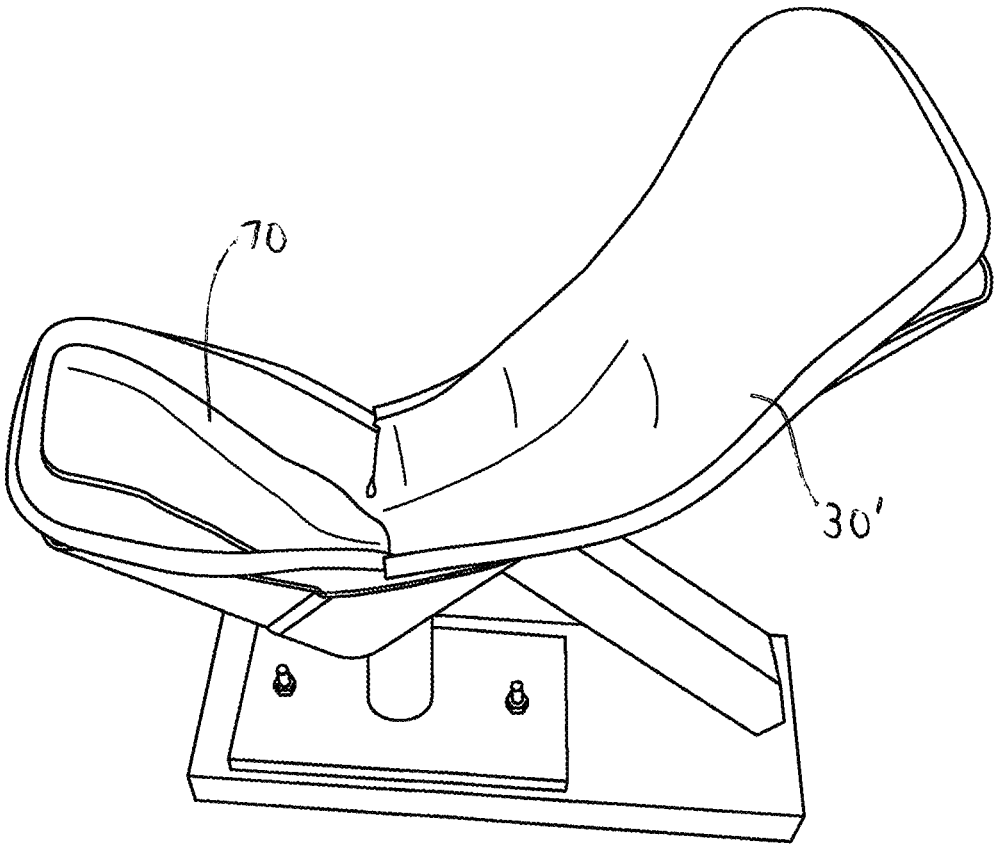
FIG. 6 is a perspective view of an embodiment showing an insert positioned on top of the foam pad of the boot, the tensioning mechanism and other components of the boot (surgical positioning device) removed for clarity.
Figure 7:
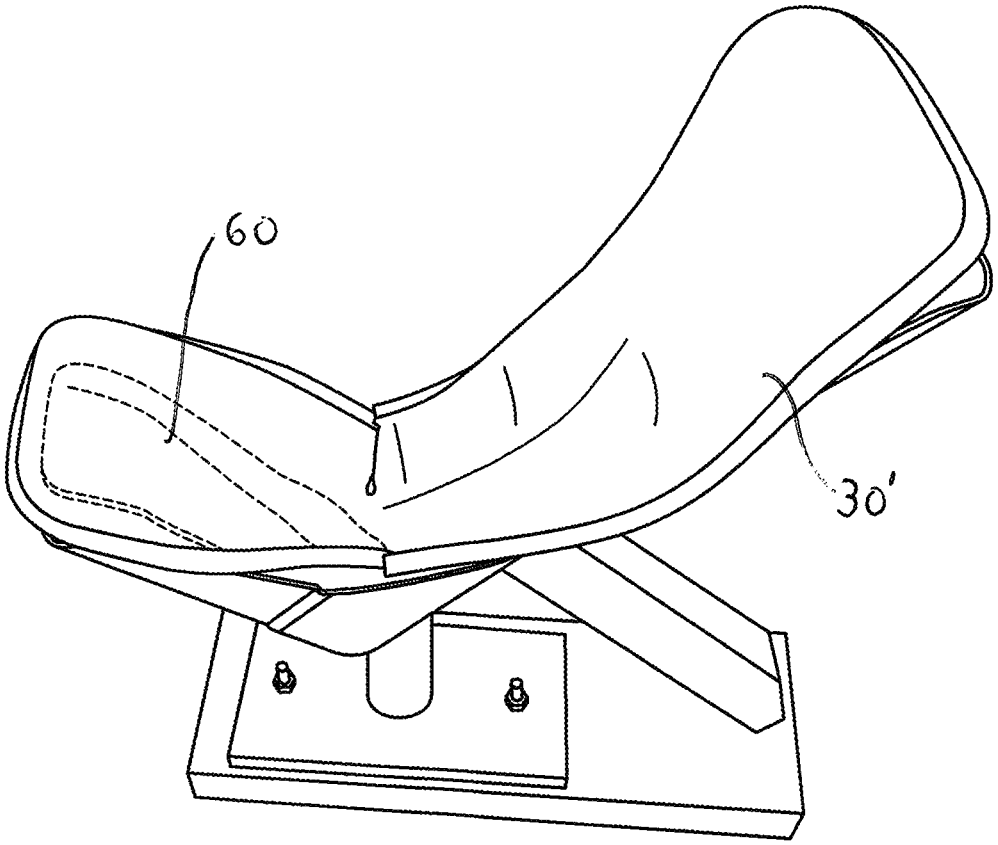
FIG. 7 is a perspective view of an embodiment showing an insert positioned underneath the foam pad of the boot, the tensioning mechanism and other components of the boot (surgical positioning device) removed for clarity.

In the embodiment of FIG. 7, the arch supporting insert 60 is a separate component which is placed/positioned under the foam pad 30'. Thus, the insert 60 is positioned between the foam pad 16 and the boot 10. In some embodiments, the insert 60 abuts the hard surface of the boot 10. The insert 60 supports the arch in the manner described herein to prevent pronation and supination during immobilization of the foot during surgery. In the embodiment of FIG. 6, the insert 70 is positioned on top of foam 30' to support the arch in the manner as the other arch supports described herein.

Note the foam insert of the present invention can be provided with different sized arches to accommodate different patient foot sizes. The arch supports can be of different widths, lengths, depths, etc. Also, the peripheral wall can be of different sizes and heights to provide different depths of indentations.

Additionally, it is contemplated that in some embodiments, foam inserts/pads with different shapes, different depth of indentations, and/or different angles of indentation and/or other variations can be utilized to provide different arch supports to specifically accommodate for pronation or supination of the arch, with the surgeon selecting the appropriate, size, shape, degree of indentation, etc. for the specific patient to accommodate the specific anatomy.

Figure 8:
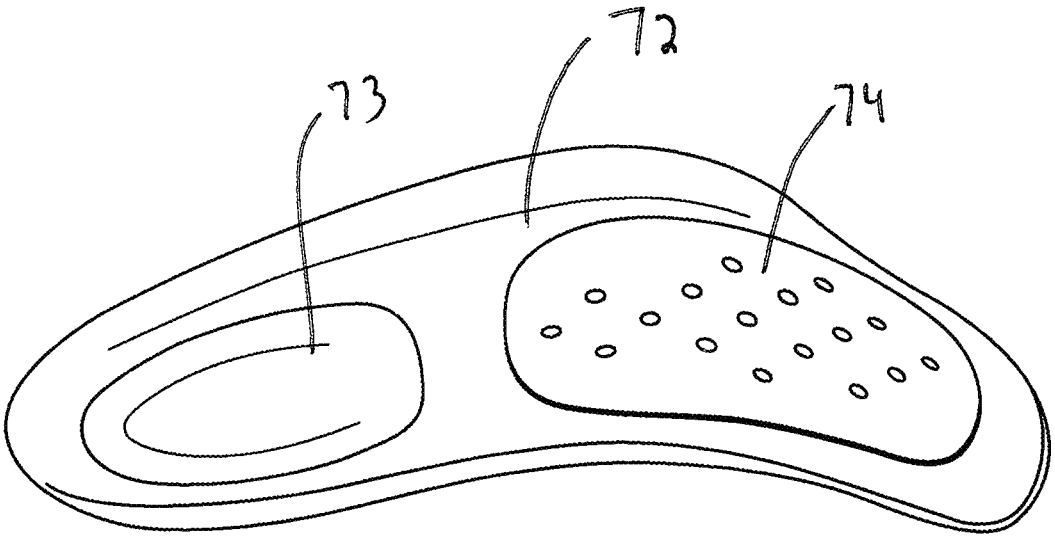
FIG. 8 is a perspective view of an alternate insert for use in the boot.
Figure 9:
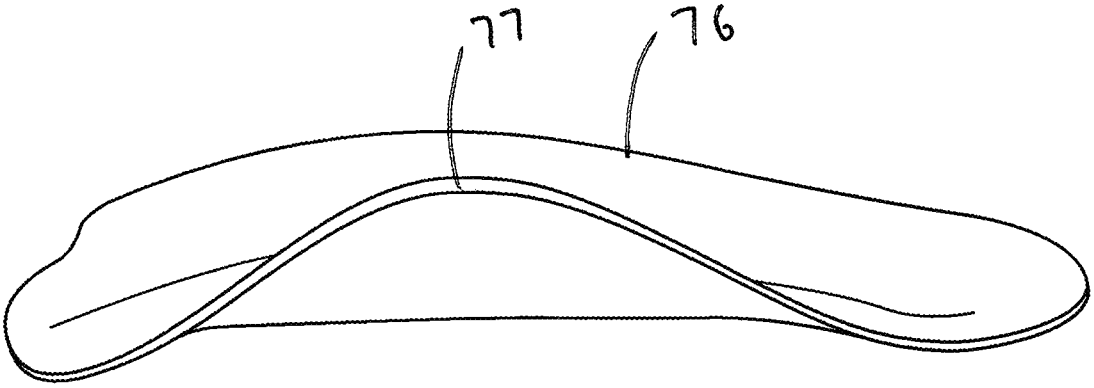
FIG. 9 is a perspective view of another alternate insert for use in the boot.

FIGS. 8 and 9 show alternate embodiments of arch supports/inserts which can be utilized. The insert 72 of FIG. 8 includes additional padding 73, 74 in the heel and ball portion. Padding 74 can include openings for breathability. FIG. 9 shows insert 76 with a larger arch height 77.

The arch inserts of the present invention can be packaged/sold separately or packaged/sold as a kit containing two or more of the same or differently sized, shaped, etc. inserts. The arch inserts can be packaged/sold separately from the surgical boot or packaged/sold as a unit with the surgical boot, either independent or attached. The arch inserts can be packaged/sold separately from the foam pad or packaged/sold as a unit with the foam pad, either independent or attached or integral.

In an alternate embodiment, instead of the arch support integrated into the insert, e.g., integrated into the foam material, as shown in FIGS. 4 and 5, the arch support can be the same material as the foam insert (pad) and the foam material formed with different thicknesses to create the arch support. As can be appreciated from the discussion above, in alternate embodiments, instead of the arch support integrated in the foam or formed by the foam itself, the arch support (insert) could be provided as a separate component and attached to the pad, e.g., foam material, prior to surgery. The arch support in such embodiments can be attached to the pad by adhesive or other modes of attachment. Alternatively, it is not attached to the pad but just placed on top or underneath.

The arch supporting insert can be made of various materials such as thermally formed plastic, high durometer rubbers, dense foam, metals such as aluminum, or other materials. The arch inserts can be supplied sterile for sterile engagement with the boot and patient. The arch inserts can be disposable so they are designed for use for a single surgical procedure. It is also contemplated that in alternate embodiments, the arch inserts can be composed of a material that can be resterilized for subsequent use in other surgical procedures.

The arch supports of the present invention accommodate patients with low arches/flat feet or high arches and support the foot's natural arch.

A wide range of orthotics including customized orthotics are contemplated. These include for example, 1) Functional Foot Orthosis (FFO) which are designed to realign joints and bones in the foot, reducing stress on the knee, ankle, or foot, and can include features like a) heel skives for angled support; b) deep heel cups for increased control; and c) medial flanges to capture the midfoot; 2) Total Contact Insoles (TCI) which are custom-designed to redistribute weight evenly across the foot, offering better shock absorption than FFOs, and typically made from materials like Ethyl Vinyl Acetate (EVA); and 3) Custom Arch Supports which are designed to provide specific support to the arches of the feet, accommodating unique foot structures.

The arch supports of the present invention, whether integrated, e.g., embedded, with the soft insert (pad) or composed of a separate material, or being a separate component, prevent collapse of the arch, i.e., prevents the arch to be compressed or in tension during securement to the boot. This is especially beneficial during robotic surgery because the robot can't accommodate movement. Thus, the arch support of the present invention provides better anatomical alignment to reduce anatomic compromise and maintain correct general anatomy.

The robotic assisting system ROSA (Zimmer) uses optical trackers and a mini-camera attached to the patient's leg to determine the exact position of the knee in space, making adjustments even with slight movements to ensure precise implant placement. Another robotic system utilized is the Stryker Mako. However, traditional knee positioners use sterile protective pads and wrap and squeeze the foot to secure the patient's leg. This method leads to foot arch collapse, pronation, and significant knee alignment changes (from <15 degrees to 20-30 degrees). The present invention is designed to prevent these unexpected changes. For example, the arch supporting inserts of the present invention seek to improve the outcomes of the ROSA system.

Reports have shown the ROSA system demonstrates varying levels of accuracy across different planes Frontal Plane (High Accuracy):

- Hip-Knee-Ankle (HKA) angle: 89% within 3° of planned angle
- Alpha (α) angle: 100% within 3°
- Beta (β) angle: 92% within 3°

Sagittal Plane (Lower Accuracy):

- Gamma (γ) angle: 77% within 3°
- Delta (δ) angle: 74% within 3°

As can be appreciated from the above, the sagittal plane has the lower accuracy since 23% of the surgery is outside the 3° in the gamma angle and 26% is outside the delta angle. These inaccuracies are oftentimes due to alignment changes while the foot is held tight in the boot. The arch supports of the present address this by reducing the misalignment, e.g., preventing unexpected pronation, and thus can double the accuracy from about 3 degrees to about 1.5 degrees or better so a greater number of patients are within a better angle. Additionally, the arch supports can improve the percentage of patients that are within the 3° for example, over 80%. Thus, the arch inserts of the present invention aim to address these discrepancies, particularly in the sagittal plane, to improve overall surgical outcomes.

Although the arch inserts of the present invention have been described for use with knee surgery such as PKA or TKA, it is also contemplated to be used in other knee surgeries as well as in hip surgery or other sugeries.

It is envisioned in some embodiments that the arch support can be integrated into the hard shell boot itself and the pad placed over the arch support is sufficiently conformable so as not to inhibit the arch support function of the boot.

The foam material of the present invention can be absorbent or superabsorbent to absorb blood and/or other body fluids. This absorbability can be part of the foam material itself and/or in form of absorbable inserts placed in and/or on the foam.

The arch supports described herein are designed to address orthopedic misalignment caused by trapping the foot in a non-anatomical position. It could also be used for patients already using orthotics to correct alignment and the insert maintains the alignment during surgery.

Although the apparatus and methods of the subject invention have been described with respect to preferred embodiments, those skilled in the art will readily appreciate that changes and modifications may be made thereto without departing from the spirit and scope of the present invention as defined by the appended claims. Persons skilled in the art will understand that the various embodiments of the disclosure described herein and shown in the accompanying figures constitute non-limiting examples, and that additional components and features may be added to any of the embodiments discussed herein without departing from the scope of the present disclosure.

It will be understood by those skilled in the art that the above particular embodiments are shown and described by way of illustration only. The principles and the features of the present disclosure may be employed in various and numerous embodiments thereof without departing from the scope and spirit of the disclosure as claimed. The above-described embodiments do not restrict the scope of the disclosure.

Additionally, persons skilled in the art will understand that the elements and features shown or described in connection with one embodiment may be combined with those of another embodiment without departing from the scope of the present invention and will appreciate further features and advantages of the presently disclosed subject matter based on the description provided.

Throughout the present disclosure, terms such as "approximately," "about", "generally," "substantially," and the like should be understood to allow for variations in any numerical range or concept with which they are associated. It is intended that the use of terms such as "approximately", "about", "substantially", and "generally" should be understood to encompass variations on the order of 25%, or to allow for manufacturing tolerances and/or deviations in design.

The recitation of numerical ranges by endpoints includes all numbers within the range.

Although terms such as "first," "second," "third," etc., may be used herein to describe various operations, elements, components, regions, and/or sections, these operations, elements, components, regions, and/or sections should not be limited by the use of these terms in that these terms are used to distinguish one operation, element, component, region, or section from another. Thus, unless expressly stated otherwise, a first operation, element, component, region, or section could be termed a second operation, element, component, region, or section without departing from the scope of the present invention.

Each and every claim is incorporated as further disclosure into the specification and represents embodiments of the present disclosure. Also, the phrases "at least one of A, B, and C" and "A and/or B and/or C" should each be interpreted to include only A, only B, only C, or any combination of A, B, and C.

What is claimed is:

1. An insert for use during orthopedic knee surgery, the insert configured for positioning in or on a boot having a hard shell and configured to stabilize a foot of a patient during orthopedic knee surgery, the boot having a continuous heel region to support a heel of the patient, the insert being sterile and of a softer surface than the hard shell and including a heel region to support a heel of the patient and having a bend adjacent the heel and an arch support, the insert having an upper surface extending continuously in the heel region configured to overlie the heel region of the boot and underlie the heel of the patient, the arch support having a non-planar surface, the arch support configured to support an arch of the foot of the patient during stabilization of the foot during orthopedic knee surgery thereby promoting proper alignment of the foot and ankle and preventing collapse of the arch during securement of the foot in the boot, wherein the insert is composed of a foam material and the arch support is a) embedded in the foam material, b integral with the foam material, c) positionable on top of the foam material or d) positionable under the foam material.

2. The insert of claim 1, wherein the arch support is customized to accommodate the foot of the patient.

3. The insert of claim 1, wherein the insert is placeable in one of a left or right boot to accommodate a left or right foot of the patient accordingly.

4. A system for supporting a foot of the patient during surgery, the system comprising a) a stabilization boot for supporting the foot of a patient, the stabilization boot having a hard shell and including a lower region to accommodate a foot of the patient and an upper region to accommodate a portion of a leg of the patient, the stabilization boot including a tightening mechanism to secure the leg of the patient, the lower region of the boot is continuous with the upper region and includes a heel region configured to support a heel of the patient;

b) a pad positioned on the boot to cushion one or both of the foot and leg of the patient, the pad of a softer surface than the hard shell and extending continuously from a lower region to accommodate a foot of the patient to a heel region and to an inserts upper region to accommodate a portion of the leg of the patient; and c) a sterile arch supporting insert, the arch supporting insert including an arch support region configured to promote proper alignment and prevent collapse of the arch of the patient during securement of the foot in the stabilization boot during orthopedic surgery, the arch supporting insert including a heel region configured to overlie the heel region of the boot and to underlie the heel of the patient;

d) wherein the arch supporting insert is a) embedded in the pad, b) integral with the pad, c) positionable on top of the pad or d) positionable under the pad.

5. The system of claim 4, wherein the arch supporting insert is non-removable from the pad.

6. The system of claim 4, wherein the arch supporting insert placeable on top of or under the ad is removably attached to the pad.

7. The system of claim 4, wherein the pad is composed of a foam material.

8. The system of claim 4, wherein the arch supporting insert has a non-planar surface facing the arch of the patient.

9. A device for supporting a foot of a patient during orthopedic knee surgery, the device being sterile and comprising a foam pad configured for placement on a foot positioning boot which stabilizes the patient's foot during orthopedic knee surgery, the foam pad including a heel region to underlie and support a heel of the patient, a leg region and an arch supporting region to support an arch of the patient and maintain alignment and prevent collapse of the arch during stabilization of the patient's foot during orthopedic knee surgery, the heel region, leg region and arch supporting region being continuous, wherein the arch supporting region is a) embedded in the pad, b) integral with the pad, c) positionable on top of the pad or d) positionable under the pad.

10. The device of claim 9, wherein the arch supporting region is non-planar.

* * * * *